United States Patent [19]

Kott, Jr.

[11] Patent Number: 4,896,651

[45] Date of Patent: Jan. 30, 1990

[54] PORTABLE, COLLAPSIBLE COOKING GRILL

[76] Inventor: Mel H. Kott, Jr., 421 E. Harrison, Harlingen, Tex. 78550

[21] Appl. No.: 347,513

[22] Filed: May 3, 1989

[51] Int. Cl.[4] ..... F24B 3/00

[52] U.S. Cl. ..... 126/30; 248/156; 248/545

[58] Field of Search ..... 126/25 R, 9 R, 29, 30, 126/9 B; 248/156, 545; 99/446, 450

[56] References Cited

U.S. PATENT DOCUMENTS

| | | | |
|---|---|---|---|
| 750,742 | 1/1904 | Weston | 126/30 |
| 2,123,329 | 7/1938 | Combs et al. | 126/30 |
| 2,523,200 | 9/1950 | Durst, Jr. | 126/137 |
| 2,805,658 | 9/1957 | Schlueter | 126/30 |
| 2,977,953 | 4/1961 | Dowdy | 126/30 |
| 3,162,113 | 12/1964 | Tallaksen | 126/30 |
| 3,395,692 | 8/1968 | Johns | 126/30 |
| 4,235,034 | 11/1980 | Black | 248/156 |
| 4,240,766 | 12/1980 | Smith et al. | 404/10 |
| 4,351,312 | 9/1982 | Ivy | 126/30 |
| 4,538,589 | 9/1985 | Preston | 126/30 |
| 4,719,898 | 1/1988 | Stanislawski | 126/9 R |

FOREIGN PATENT DOCUMENTS

| | | | |
|---|---|---|---|
| 2614059 | 10/1988 | France | 248/545 |

*Primary Examiner*—James C. Yeung
*Attorney, Agent, or Firm*—David L. Mossman

[57] ABSTRACT

A portable, collapsible cooking grill assembly for use at temporary camp sites has an elongated spud support which is driven into the ground by means of a driving tool having an impact head at its upper end. The impact head absorbs the force of the blows used to install the spud support in the ground. The driving tool is then removed and a grill support post is removably fit on the spud support. A removable grill may then be placed on the grill support post. The driving tool thus spares the spud support, grill support post and grill from any damage that may occur from hammer blows during installation. The height and lateral position of the grill may also be easily adjusted.

13 Claims, 1 Drawing Sheet

PORTABLE, COLLAPSIBLE COOKING GRILL

FIELD OF THE INVENTION

The invention relates to cooking grills, and more particularly relates to cooking grills, such as outdoor barbeque grills, which collapse to occupy less space while being transported and stored.

BACKGROUND OF THE INVENTION

In the field of camping and other temporary living accommodations, it has long been a goal to provide equipment that is lightweight and which occupies a minimum amount of space to maximize its portability to and from the camp site. This goal is particularly true for cooking grills. Conventional cooking grills, such as those found in public parks, are generally heavy, being commonly fashioned from cast iron or the like. Such grills also typically comprise an upright or vertical support post secured in the ground with a grill horizontally supported therefrom. Often, the grill is positioned at average waist height so that the cook need not bend over to tend the food.

Portable cooking grills are often of similar design, usually providing a vertical support post with the grill supported off of one side so that a fire may be built beneath the grill. Since the support post and grill are at right angles to each other in all common versions of such grills, and since such orientation occupies a large volume relative to the total mass of the grill assembly, the grill itself is often designed to be removably mounted upon the support post. In a typical set-up procedure, the post is driven into the ground at the camp fire site by hammering the top of the post and the grill is then attached to the post.

Among the known portable cooking stove designs is the one illustrated in U.S. Pat. No. 750,742 which depicts a stake or post having a threaded cap on the upper end thereof, a sleeve screwed on the lower end of the post and a pointed wooden peg driven into the sleeve. One or more circular shelves having a concentric hole therethrough may be removably mounted on the stake through the hole, and the shelves may be enclosed with a cylindrical wall to form an oven. The stove is positioned upright by hammering on the threaded cap to drive the wooden peg into the ground. U.S. Pat. No. 2,523,200 illustrates a removable fireplace grill having a tubular, telescoping support member with pointed ends for mounting within a corner of a conventional fireplace. A rotatable grill mounted offcenter on the support member may be swung into and out of the fireplace.

A portable grill of the type described with a support post having a grill detachably mounted thereon for suspension over a fire is seen in U.S. Pat. No. 2,977,953. In this case, the grill is attached to a sleeve around the post and is free to rotate around the post as well as up and down. The grill is secured by a set screw in the sleeve that bears against the post. The post of this patent has a protective cap at the top. A very similar design is seen in U.S. Pat. No. 4,538,539, except that the sleeve has a handle and the set screw itself is also provided with a handle. The post has a cap with hooks for holding utensils. The cap appears to be on when the post is driven into place.

U.S. Pat. No. 3,395,692 is of a similar type as that of U.S. Pat. No. 2,977,953, except that the former has a locking ring to secure the position of the sleeve, where the locking ring surrounds the post and travels on the upright member along with the sleeve. Illustrated in U.S. Pat. No. 4,351,312 is yet another grill of similar design where the vertical height adjustment is made by a bight that slides into slots on the support post where the bight is secured by a lock that slides over the post. The outdoor cook grill of U.S. Pat. No. 4,719,898 is also of similar design, except that the grill is removably mounted on the post by means of rod-like hanger supports on the post and a chain that suspends the grill over the fire.

While all of these portable cooking grills accomplish the basic task of providing a grill which may be quickly disassembled into a compact arrangement for easy transportation, they all have the disadvantage of having support posts with a top end that is vulnerable to damage when the post is driven into the ground. It will be appreciated unless the post is made from exceptionally hard materials, which might make its cost and or weight unacceptably high, that the top end of the post quickly becomes flattened and deformed after repeated blows with a hardened hammer or axe head. Such damage may occur in only one set-up operation if the ground is hard. While the posts of the grills of U.S. Pat. Nos. 750,742; 2,977,953 and 4,538,589 are provided with caps, the caps themselves may be damaged in like fashion, thereby hampering any other function that the cap may have.

It would thus be advantageous if a portable cooking grill assembly would be devised whereby damage to the support post would be minimized. Obviously, an advantage to the portable grill is that it is often reused. However, five of the grills discussed could be irreparably damaged if the top of the post were deformed since the sleeve upon which the grill is mounted would be prevented or at the least inhibited from being removed from or placed over the top of the post.

SUMMARY OF THE INVENTION

Accordingly, it is an object of the present invention to provide a cooking grill that may be easily collapsed and transported.

It is another object of the present invention to provide a portable, collapsible cooking grill assembly having a mechanism by which it may be easily erected but which would permit no damage to the operating features of the grill.

It is yet another object of the invention to provide a portable, collapsible cooking grill where the grill may be laterally or rotatably adjusted around a vertical support post, and also have its height easily adjusted.

In carrying out these and other objects of the invention, there is provided, in one form, a portable, collapsible grill assembly having a detachable grill and a grill support post with a mechanism for supporting the detachable grill. Also part of the assembly is an elongated spud support having a first end with a tapered portion to be driven into the ground and a second end having a feature for engaging and supporting the grill support post. Another part of the assembly is a removable driver tool having a feature for temporarily engaging the elongated spud support at the second end and an impact head to be struck to drive the elongated spud support into the ground by the first, tapered end.

DETAILED DESCRIPTION OF THE INVENTION

Figure 1:
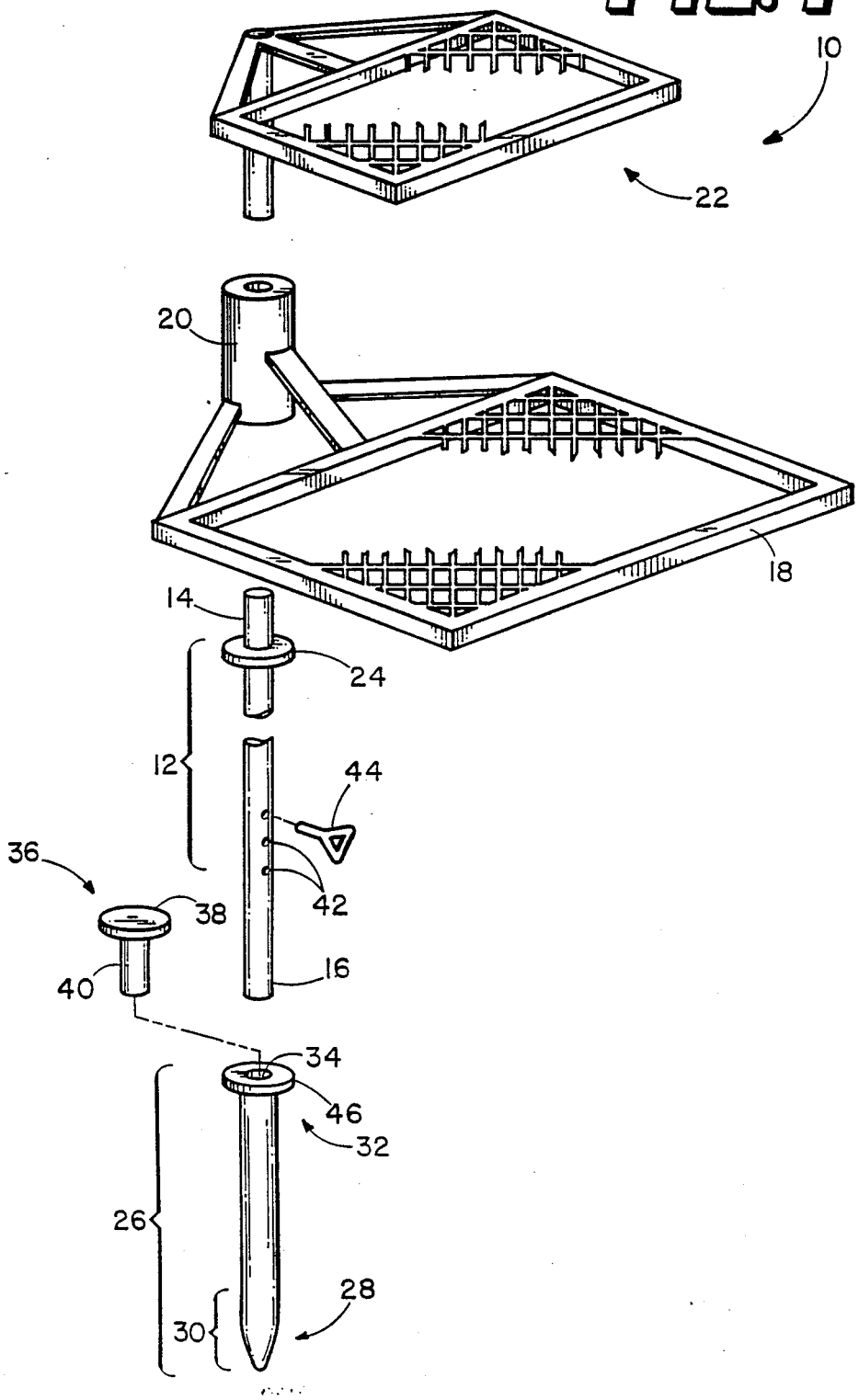
FIG. 1 illustrates an exploded, perspective view of the portable, collapsible grill of the present invention oriented as it might be prior to set up.

The invention will now be described in more detail with reference to FIG. 1. The portable, collapsible grill assembly 10 has a grill support post 12 with a first, top end 14 and a second, bottom end 16. A mechanism is provided to support detachable grill 18, which mechanism may be grill support ring 24 if sleeve 20 does not have a closed end. Alternatively, if the grill 18 is provided with a sleeve 20 having a closed end, the closed end may contact the top end 14 to support grill 18. It will be appreciated that the invention is not limited to the specific grill support mechanisms shown, but that others may be suitable. The grill 18 may be designed to rotate around support post 12. For example, top end 14 and sleeve 20 both have circular cross sections to permit such free rotation. One or more optional food warming or utensil holding trays 22 may also be provided above the grill 18 in a similar fashion to the ways in which grill 18 may be supported.

An important part of the portable, collapsible grill assembly 10 is elongated spud support 26 which has a first end 28 with a tapered, or pointed portion 30 to enable the support 26 to penetrate the ground, and a second end 32 having a companion mechanism to engage and support the grill support post 12. The companion mechanism may be as simple as an elongated hollow opening 34 to receive bottom end 16 of post 12. Again, the end 16 may be adapted to freely rotate within the opening 34, such as if they both have circular cross sections, providing another way of moving the grill 18 to enhance its versatility.

Of course, it will be appreciated that the exact design of end 16 may vary as may the design of the interior of opening 34. A circular cross section for these elements is one useful variation since it is easy to manufacture and permits for the free rotation of grill 18. However, other ways by which post 12 may be mounted on spud support 26 may be envisioned. For example, in one possible alternate structure, the end 16 may be hollow to receive the top end 32 of the spud support 26, for example, and the invention is not limited to any particular mechanism of engagement.

Complementary to elongated spud support 26 is removable driver tool 36 which has a feature for temporarily engaging the elongated spud support 26 at the second end 32, and an impact head 38 to be struck when the driver tool 36 is fitted with or engages with the spud support 26 to drive the support 26 into the ground, tapered end 30 first. The feature for engaging the elongated spud support 26 is illustrated as a shaft 40 similar in shape to bottom end 16 of post 12, although it may be of other shape. The function of the shaft 40 is to keep the impact head 38 properly aligned on the spud support 26. To fulfill this function, shaft 40 should preferably have a length at least one-quarter that of opening 34 in spud support 26 as shown in FIG. 1. Impact head 38 should be sturdy enough to withstand repeated blows with a hammer, mallet, or the like. Further, impact head 38 must be securely affixed to shaft 40.

Collapsible grill assembly 10 may also be provided with a grill height adjustment feature. This feature may take the form of a plurality of openings 42 along a portion of the length of grill support post 12. A removable stop mechanism such as pin 44 may then be replaceably inserted into one of the openings 42. Stop pin 44 should extend out from the body of support post 12 sufficiently to engage the upper, second end 32 of spud support 26 to prevent post 12 from sliding further into spud support 26. A flange 46 or other feature may be present at the upper end 32 of spud support 26 to more surely engage stop pin 44. Flange 46, which would be in a generally normal orientation to the generally vertical direction of spud support 26, would serve the additional purpose of helping to transfer the driving or implanting force from driver tool 36 to spud support 26, as well as aid in the removal of spud support 26 from the ground when breaking camp. Preferably, flange 46 completely encircles the upper edge of elongated spud support 26 as shown in FIG. 1 to provide a continuous impact surface during the installation operation. It will be appreciated that any of the other mechanisms used to adjust the height of the grill previously discussed with reference to the U.S. patents might be adapted to serve with the present invention.

In the installation of the portable, collapsible grill assembly 10 of the present invention, driver tool 36 is inserted into elongated spud support 26 by placing shaft 40 into elongated hollow opening 34. This sub-assembly is then placed on the ground with the tapered portion 30 at the desired cooking grill site and driven in by hammering impact head 38 with a conventional hammer or other suitable tool. Any damage that may result from driving spud support 26 into the ground occurs at impact head 36 which is now removed by withdrawing drive tool 36 from spud support 26. Impact head 38 thus protects the remainder of the collapsible grill assembly 10 from damage. Flange 46 may serve the additional purpose of limiting the depth to which spud support 26 may be driven into the ground, thus regulating its depth to that which is suitable for securely supporting grill 18 but no further.

Next, grill support post 12 is inserted into spud support 26 by placing bottom end 16 into elongated hollow opening 34. The grill 18 may now be attached and its height and angular or lateral position around the support post 12 adjusted by the mechanisms described earlier.

It will be appreciated that the invention is not limited to being fashioned from any particular material as long as it is strong enough to maintain its shape over time, through handling and repeated installation and upon exposure to heat. It can be appreciated that one may want to fabricate the driver tool 36 out of a material that can withstand repeated sharp impact. Since driver tool 36 is only a small part of the overall assembly 10, one may consider using a very durable, but more expensive alloy, recognizing that the relatively small increase in manufacturing cost may be justified.

Removal of the assembly 10 is straightforward and a reversal of the installation steps, except that driver tool 36 is not employed. The presence of flange 46 on second end 32 of spud support 26 would provide a grip for the camper to remove support 26 from the ground.

Many modifications may be made in the invention by those of ordinary skill in the art without departing from the spirit and scope of the invention which are defined only by the appended claims. A few modifications have been suggested during the course of the description herein, and others may become apparent. For example, it may be desirable to limit the rotation of the driver tool 36 within spud support 26 during the installation of the support 26 in the ground so that the hammer blows are true and do not slip. In this case, the cross sections of shaft 40 and hollow opening 34 could be designed to be corresponding and non-circular.

I claim:

1. A portable, collapsible grill assembly comprising:
a detachable grill;
a grill support post comprising:
means for supporting the detachable grill; and
means for engaging and being supported by an elongated spud supporting comprising:
a first end having a tapered portion to be driven into the ground; and
a second end having companion means for engaging and supporting the grill support post, where the second end additionally comprises a flange oriented normal to and encircling the elongated spud support; and
a driver tool comprising:
means for temporarily engaging the elongated spud support at the second end; and
an impact head to be struck when the tool has engaged the elongated spud support to drive the elongated spud support into the ground by the first end thereof.

2. The portable, collapsible grill assembly of claim 1 where the companion means in the second end of the elongated spud support is an elongated, hollow opening.

3. The portable, collapsible grill assembly of claim 2 where the means on the grill support post for engaging and being supported by the elongated spud support is a lower end to fit within the elongated hollow opening.

4. The portable, collapsible grill assembly of claim 3 where the elongated hollow opening and the lower end are cylindrical and the grill support post is then permitted to rotate within the elongated spud support.

5. The portable, collapsible grill assembly of claim 3 where the lower end of the grill support post comprises a plurality of openings along its length, and the portable, collapsible grill assembly further comprises a removable stop to mate with the openings in the grill support post lower end to prevent the grill support post from descending beyond the removable stop into the elongated spud support.

6. The portable, collapsible grill assembly of claim 1 where the grill support post is provided with means to adjust the height of the detachable grill with respect to the ground.

7. The portable, collapsible grill assembly of claim 1, where in the elongated spud support, the companion means for:
engaging and supporting the grill support post is an elongated opening having a length, and
wherein the driver tool, the means for temporarily engaging the elongated spud support at the second end of the spud support, is a shaft having a length at least one-quarter the length of the elongated opening in the elongated spud support.

8. A portable, collapsible grill assembly comprising:
a detachable grill;
an elongated grill support post comprising:
a first post end having means for temporarily supporting the detachable grill; and
a second post end having a circular cross section;
an elongated spud support for supporting the grill support post comprising:
a first spud end having a tapered portion to be driven into the ground; and
a second spud end having an elongated, hollow opening with a circular cross section for receiving the second post end of the grill support post permitting the second post end to rotate within the elongated spud support, the second spud end further comprising a flange oriented normal to and encircling the direction of the elongated spud support; and
a removable driver tool comprising:
a shaft to be temporarily received by the elongated, hollow opening of the elongated spud support; and
an impact head on the shaft to be struck when the tool has engaged the elongated spud support to drive the elongated spud support into the ground by the first, tapered spud end thereof.

9. The portable, collapsible grill assembly of claim 8 where the grill support post is provided with means to adjust the height of the detachable grill with respect to the ground.

10. The portable, collapsible grill assembly of claim 9 where the lower end of the grill support post comprises a plurality of openings along its length, and the portable, collapsible grill assembly further comprises a removable stop to mate with the openings in the grill support post lower end to prevent the grill support post from descending beyond the removable stop into the elongated spud support.

11. The portable, collapsible grill assembly of claim 8,
wherein the elongated spud support, the elongated, hollow opening has a length; and
wherein the driver tool, the shaft for being temporarily received by the elongated spud support at the second end of the spud support, has a length at least one-quarter the length of the elongated, hollow opening of the elongated spud support.

12. A portable, collapsible grill assembly comprising:
a detachable grill;
an elongated grill support post comprising:
a first post end having means for temporarily supporting the detachable grill; and
a second post end having a circular cross section;
an elongated spud support for supporting the grill support post comprising:
a first spud end having a tapered portion to be driven into the ground;
a second spud end having an elongated, hollow opening with a circular cross section for receiving the second post end of the grill support post permitting the second post end to rotate within the elongated spud support; and
a flange completely encircling the second spud end oriented such that it is normal to the elongated spud support;
a removable driver tool comprising:
a shaft to be temporarily received by the elongated, hollow opening of the elongated spud support, where the shaft has a length which is at least one-quarter the length of the elongated, hollow opening of the elongated spud support; and
an impact head on the shaft to be struck when the tool has engaged the elongated spud support to drive the elongated spud support into the ground by the first, tapered spud end thereof; and means to adjust the height of the detachable grill with respect to the ground.

13. The portable, collapsible grill assembly of claim 12 where the lower end of the grill support post comprises a plurality of openings along its length, and the portable, collapsible grill assembly further comprises a removable stop to mate with the openings in the grill support post lower end to prevent the grill support post from descending beyond the removable stop into the elongated spud support, where the openings and the removable stop provide the grill height adjustment means.

* * * * *